United States Patent [19]

Wong

[11] 4,293,896

[45] Oct. 6, 1981

[54] BATTERY-OPERATED LANTERN

[75] Inventor: Chung-Chee Wong, Kowloon, Hong Kong

[73] Assignee: San P. Kong, Kowloon, Hong Kong

[21] Appl. No.: 57,675

[22] Filed: Jul. 16, 1979

[30] Foreign Application Priority Data

Jul. 20, 1978 [GB] United Kingdom ..... 30445/78

[51] Int. Cl.[3] ..... F21L 7/00

[52] U.S. Cl. ..... 362/200; 362/217; 362/374

[58] Field of Search ..... 362/200, 217, 374

[56] References Cited

U.S. PATENT DOCUMENTS 4,079,243 3/1978 Pemberton ..... 362/200

*Primary Examiner*—Stephen J. Lechert, Jr.

*Attorney, Agent, or Firm*—Wenderoth, Lind & Ponack

[57] ABSTRACT

A battery-operated lantern has two rows of single-cell batteries disposed end-to-end in its body, the two rows being side-by-side and parallel, and the body has a closure member with an insulated contact plate secured to it for engagement by the central electrode of the adjacent cell in one row and by the base of the adjacent battery in the other row, for connecting the batteries in one row in series with those in the other row. The electrical contacts at the other end of the casing are constituted by respective coil springs which serve also to press the batteries in the two rows towards the contact plate. The closure member has a spring-loaded catch which automatically secures the member as it is moved into a closed position on the body.

4 Claims, 2 Drawing Figures

BATTERY-OPERATED LANTERN

This invention relates to battery-operated lanterns.

According to this invention there is provided a battery-operated lantern comprising a hollow body having therein an elongated tubular compartment for a plurality of single-cell batteries arranged end-to-end in two side-by-side rows and all electrically connected in series with each other, said body including a bottom wall having an aperture therein opening into one end of said compartment and through which aperture batteries can be inserted into and removed from the compartment lengthwise of the batteries; a closure member mounted in said aperture, which closure member is made from an electrically insulating material and which extends in a plane normal to the lengthwise dimension of said elongated compartment, said closure member being movable out of said aperture; a rigid metal contact plate mounted on and electrically insulated from the inner face of said closure member and adapted to make electrical contact with the base of the adjacent battery in one of said rows and with the central electrode of the adjacent battery in the other of said rows; a pair of contact elements at the end of said elongated compartment remote from the closure plate and arranged respectively to make electrical contact with the central electrode of the adjacent battery in said other row and said contact elements being resilient for pressing the batteries in the respective rows resiliently lengthwise of the batteries towards the closure member; a spring loaded catch at one edge of said closure member for automatically locking the plate in its closed position as the plate is moved into said closed position, and a manually operable element for freeing the catch.

Figure 1:
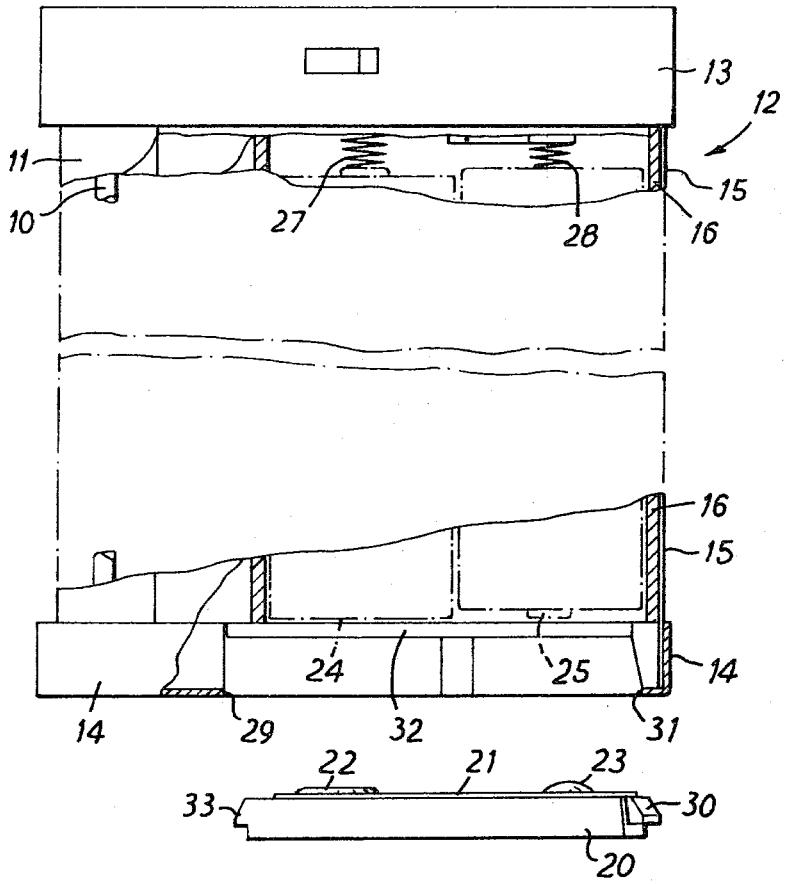
Figure 2:
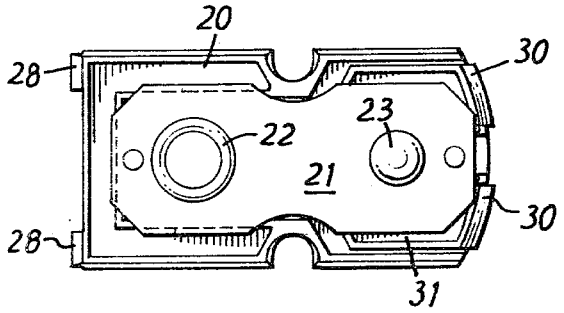

One embodiment of the invention will now be described by way of example with reference to the accompanying drawings in which:

FIG. 1 is a part elevation, partly in section, of a lantern according to the invention, the closure member being shown detached, and FIG. 2 is a view of the closure member looking toward its inner side.

The lantern shown in the drawings is of the kind in which the light is emitted by a fluorescent tube 10 disposed behind a transparent cover 11 forming a front portion of the hollow body 12 of the lantern. The main part of the hollow body is formed by upper and lower end caps 13 and 14 and a thin casing member 15 extending between the end caps. A liner 16 made from an insulating material is disposed within the casing behind the tube 10 and extends between the end caps to define a compartment for a plurality of single-cell batteries 18 arranged in two rows which are disposed side-by-side. The compartment has a removable closure member 20 which is made from an electrically insulating material and which has secured to its inner side a metal contact plate 21 provided with an annular embossment 22 and a domed embossment 23 for contacting the metallic base 24 and the central electrode 25 of the adjacent batteries in the two rows respectively. At the opposite end of the compartment the base and central electrode of the two batteries at the other ends of the rows are engaged by two metal spiral springs 27 and 28 constituting electrical contacts. The two springs are connected in circuit with the tube 10 and its controls (not shown).

The closure member 20 fits into a recess in the lower end member 14 and rests against two edge flanges 32 extending along opposite sides of the recess. The member 20 is held in this position by two lugs 28 at one end which fit under an edge 29 of the end member and by two lugs 30 of a catch 31 which is slidably mounted under the contact plate 21 and which is spring-loaded in a direction urging the lugs 30 into engagement under the edge of the end member at the other end 31 of the recess. A part of the catch projects through an aperture in the closure member for manual operation to release the catch. The surfaces of the lugs 30 which engage the edge flange during the act of applying the closure member are chamfered so that after the lugs 28 have been engaged under the edge 29, the closure member has only to be pressed to ensure engagement of the lugs 30 under the edge 31. When the compartment contains a full complement of batteries and the catch is operated to release the closure member the spring contacts, operating through the batteries, push the closure member 20 open to facilitate its removal from the recess.

I claim:

1. A battery operated lantern comprising: a hollow body having therein an elongated tubular compartment for a plurality of single-cell batteries arranged end-to-end in two side-by-side rows and all electrically connected in series with each other, said body including a bottom wall having an aperture therein opening into one end of said compartment and through which aperture batteries can be inserted into and removed from the compartment lengthwise of the batteries; a closure member mounted in said aperture, which closure member is made from an electrically insulating material and which extends in a plane normal to the lengthwise dimension of said elongated compartment, said closure member being movable out of said aperture; a rigid metal contact plate mounted on and electrically insulated from the inner face of said closure member and adapted to make electrical contact with the base of the adjacent battery in one of said rows and with the central electrode of the adjacent battery in the other of said rows; a pair of contact elements at the end of said elongated compartment remote from the closure plate and arranged respectively to make electrical contact with the central electrode of the adjacent battery in said other row and said contact elements being resilient for pressing the batteries in the respective rows resiliently lengthwise of the batteries towards the closure member; a spring loaded catch at one edge of said closure member for automatically securing the member in its closed position as the plate is moved into said closed position; and a manually operable element for moving the catch into an inoperative position against the restraint of its spring loading.

2. A battery operated lantern comprising: a hollow body having therein a recess for housing an elongated fluorescent light element; a fluorescent light element in said recess; said body further having a transparent cover portion over said recess for protecting said light element; said body further having an elongated tubular compartment for a plurality of single-cell batteries arranged end-to-end in two side-by-side rows extending parallel to said light element and all electrically connected in series with each other and with said light element, said body including a bottom wall having an aperture therein opening into one end of said compartment and through which aperture batteries can be inserted into and removed from the compartment lengthwise of the batteries; a closure member mounted in said aperture, which closure member is made from an electrically insulating material and which extends in a plane normal to the lengthwise dimension of said elongated compartment, said closure member being movable out of said aperture; a rigid metal contact plate mounted on and electrically insulated from the inner face of said closure member and adapted to make electrical contact with the base of the adjacent battery in one of said rows and with the central electrode of the adjacent battery in the other of said rows; a pair of contact elements at the end of said elongated compartment remote from the closure plate and arranged respectively to make electrical contact with the central electrode of the adjacent battery in said other row and said contact elements being resilient for pressing the batteries in the respective rows resiliently lengthwise of the batteries towards the closure member; a spring loaded catch at one edge of said closure member for automatically securing the member in its closed position as the plate is moved into said closed position; and a manually operable element for moving the catch into an inoperative position against the restraint of its spring loading.

3. A lantern as claimed in claim 1, wherein the contact elements are constituted by respective spiral compression springs.

4. A lantern as claimed in claim 1, wherein the body and closure member have, at the edge of the closure member remote from the catch, interengaging lugs and recesses enabling the closure member to be removed from the body when the catch is in its inoperative position.

* * * * *